US005341149A

United States Patent [19]

Valimaa et al.

[11] Patent Number: 5,341,149

[45] Date of Patent: Aug. 23, 1994

[54] ANTENNA ROD AND PROCEDURE FOR MANUFACTURING SAME

[75] Inventors: Veli-Matti Valimaa, Halikko; Ari Leman, Pertteli; Petri Hossi; Jari Olkkola, both of Salo, all of Finland

[73] Assignee: Nokia Mobile Phones Ltd., Salo, Finland

[21] Appl. No.: 856,283

[22] Filed: Mar. 24, 1992

[30] Foreign Application Priority Data

Mar. 25, 1991 [FI] Finland ..... 911435

[51] Int. Cl.[5] ..... H01Q 11/08; H01Q 1/40

[52] U.S. Cl. ..... 343/895; 343/900; 343/873; 29/600

[58] Field of Search ..... 343/895, 715, 900, 872, 343/873; 264/250, 272.15, 271.19, 262; 29/600; H01Q 11/08, 1/40, 1/36

[56] References Cited

U.S. PATENT DOCUMENTS

| | | | |
|---|---|---|---|
| 3,300,749 | 1/1967 | Lombardi | 343/895 |
| 3,541,567 | 11/1970 | Francis et al. | 343/873 |
| 3,596,273 | 7/1971 | Francis et al. | 343/895 |
| 3,828,353 | 8/1974 | Majkrzak et al. | 343/873 |
| 3,902,178 | 8/1975 | Majkrzak | 343/895 |
| 4,435,713 | 3/1984 | Gasparaitis et al. | 343/702 |
| 4,435,716 | 3/1984 | Zandbergen | 343/895 |
| 4,914,450 | 4/1990 | Dilley et al. | 343/895 |
| 5,057,849 | 10/1991 | Dörrie et al. | 343/895 |

FOREIGN PATENT DOCUMENTS

| | | | |
|---|---|---|---|
| 131836 | 9/1975 | Denmark . | |
| 0370715A3 | 11/1989 | European Pat. Off. . | |
| 2357542A1 | 5/1975 | Fed. Rep. of Germany . | |
| 77903 | 4/1962 | France | 343/895 |
| 720114 | 12/1954 | United Kingdom | 343/895 |

*Primary Examiner*—Donald Hajec
*Assistant Examiner*—Hoanganh Le
*Attorney, Agent, or Firm*—Darby & Darby

[57] ABSTRACT

An antenna rod, comprises an antenna lead passing inside the rod and a layer of polymer material outside the antenna lead. The antenna rod has improved characteristic features because the antenna lead has been immersed into the polymer material layer. The antenna rod is produced by inserting the antenna lead longitudinally in a cavity of a casting mold, which is substantially of the shape of the antenna rod and thereafter encapsulating the antenna lead with a polymer material layer. The antenna lead can be reinforced for casting by joining it with a support structure by winding the lead to form a helical coil around the support structure.

8 Claims, 3 Drawing Sheets

ANTENNA ROD AND PROCEDURE FOR MANUFACTURING SAME

BACKGROUND OF THE INVENTION

The present invention relates to an antenna rod, comprising an antenna lead and a layer of polymer material outside the antenna lead. The invention also relates to a procedure for producing the above antenna rod, comprising the encapsulating of the antenna lead extending longitudinally in the antenna rod with a layer of polymer material.

Antenna rods of the type and procedures for producing such rods are known in prior art, wherein the structure has been provided by constructing it mechanically of several separate components. Antenna rod structures composed of separate mechanical components have been less reliable in use, and joining them e.g. by gluing or pressing one into another, has caused a great number of mistakes. In addition, the earlier lead antennas based on a spiral coil have been stiff, resisting impacts poorly.

SUMMARY OF THE INVENTION

An objective of the present invention is therefore to produce an antenna rod in which the antenna lead is solidly attached to a polymer material layer that surrounds it. Another aim of the invention is to provide an antenna rod which is as reliable in use as possible and at the same time, resilient and impact-resistant. A further aim is to provide a procedure for producing an antenna rod which is as simple and reliable as possible.

In the invention, an antenna rod is provided which meets the above objectives.

The antenna rod comprises a supporting core structure which is solid and made of flexible thermoplastic material, an antenna lead wound around the supporting core structure in the shape of a helical coils and a layer of flexible thermoplastic material enclosing the antenna lead and supporting core structure.

It has been demonstrated that the properties of an antenna rod improve decisively if the antenna lead is at least partly immersed in the polymer material layer.

BRIEF DESCRIPTION OF THE DRAWINGS

Figures illustrating the invention are presented below.

DESCRIPTION OF THE PREFERRED EMBODIMENTS

Figure 1:
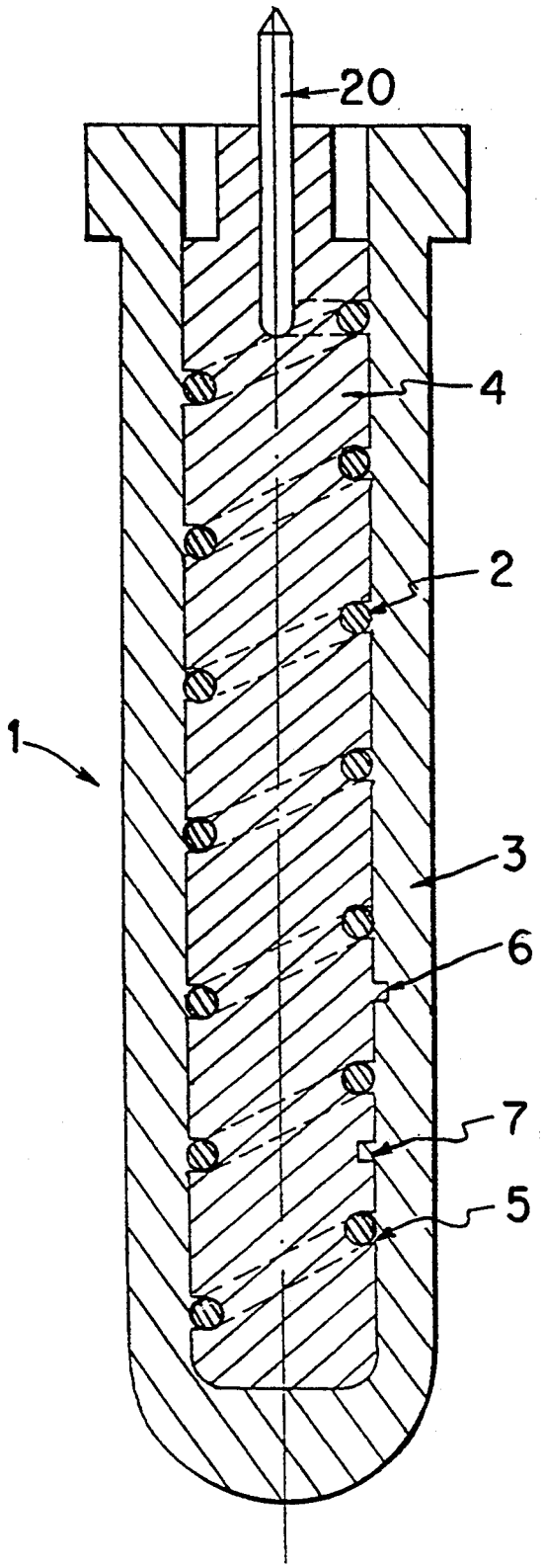
FIG. 1 is an elevational view in section of a rod according to an embodiment of the invention.

The antenna lead can be of any shape, but it is preferred that it be shaped into a helical coil passing within the antenna lead. If the antenna lead is rigid enough as such, it can be totally immersed in a polymer material layer, during the production stage whereby a structure is produced which essentially comprises only a rod-shaped polymer material matrix and an antenna lead immersed therein.

On the other hand, the antenna lead is often weak or soft in structure, so that it needs to be reinforced with a support structure passing within the antenna rod in contact with the antenna lead. The support structure is preferably a rod which is smaller than the antenna lead, around which the antenna lead is wound in the form of a helical coil in the manner described above. The support structure can be provided with a groove into which the antenna lead is inserted, and with one or more projections or recesses of the support structure contacting or engaging with the polymer material layer.

It is required that the antenna rod be resilient but firm. This sets particular requirements for the material, especially for the polymer material layer. The polymer material can be, e.g., rubber or plastic, whereby it is made of a flexible thermoplastic. The support structure can be made of any appropriate material, but it is advantageous that it also be of flexible thermoplastic, having the same or different properties compared with the surrounding polymer material layer.

In the invention, also an enhanced procedure has been provided for producing the antenna rod. Production is started by positioning the antenna lead in the cavity of a casting mold, which is essentially of the shape of the antenna rod. Thereafter, the cavity of the casting mold is filled with a curing polymer material.

If the antenna lead used in the method is rigid enough to be able to maintain its shape when the cavity of the casting mold is filled with polymer material, it can as such be positioned in the cavity and filled with curing polymer material. Hereby, an antenna rod is formed which is composed of a rod-shaped polymer material matrix into which a rigid antenna lead has been immersed. It is furthermore advantageous if the antenna lead is formed into a helical coil and then positioned in the longitudinal direction of the cavity of the casting mold. Then both the requisite resilience and appropriate length can be provided in the antenna lead.

If the antenna lead is too soft to keep its shape when filling the cavity with the polymer material, it can be joined with the support structure and then inserted with said support structure in the cavity of the casting mold, this cavity being essentially of the shape of the antenna rod. It is therefore obvious that the dimensions of the support structure are smaller than those of the antenna rod, whereby the support structure advantageously becomes entirely encapsulated by the polymer material. As taught by an advantageous embodiment of the invention, the antenna lead is joined to the rod-like support structure by winding it into a helical coil around the support structure.

As mentioned in the foregoing, the support structure may be provided with a groove on its surface, into which the antenna lead is inserted in the first step of the method. The support structure may also be provided with a projection or a recess to engage the polymer material layer while being cast.

The step in which the cavity of the casting mold is filled with a curing polymer material may be implemented by carrying out injection molding of the polymer material. This means that the injection molding cycle includes a step in which the mold is open and the antenna lead is inserted into the mold cavity, potentially with a support structure, before the mold is closed and before polymer material is injected into the cavity through one or more small holes.

According to an alternative embodiment of the invention, the support structure may also be cast in the presence of an antenna lead prior to inserting them in the antenna rod-shaped cavity of the casting mold, preferably by injection molding. One may contemplate that the antenna rod according to the invention is produced using a procedure in which a support structure is first cast in the presence of an antenna lead, thereafter the support structure with the antenna lead is placed in the antenna-shaped mold to provide an insert therein, and finally, the mold is filled with a curing polymer material. For the polymer material and preferably also for the support structure material, flexible thermoplastic material is preferably used, this being appropriate also for injection molding.

The antenna rod 1 in FIG. 1 includes an antenna lead 2 passing inside the rod, a polymer material layer 3 which is outside the antenna lead 2, and a support structure 4, encapsulating the antenna lead 2. As shown in the Figure, the support structure 4 is a rod, which is smaller than the antenna rod 1, around which rod 4 the antenna lead 2 is wound in the form of a helical coil. The antenna lead 2 terminates in a socket, prong, or equivalent, as seen in the upper part of the Figure, which socket or prong can be connected into a radio or radio telephone. The support structure 4 is provided with a groove 5 wherein the antenna lead 2 has been partly immersed. The support structure 4 is also provided with a projection 6 or a recess 7 to catch or engage the polymer material layer. Therewith, the support structure 4 (with the antenna lead 2) remains fixed firmly in place in relation to the polymer material layer 3.

Figure 2:
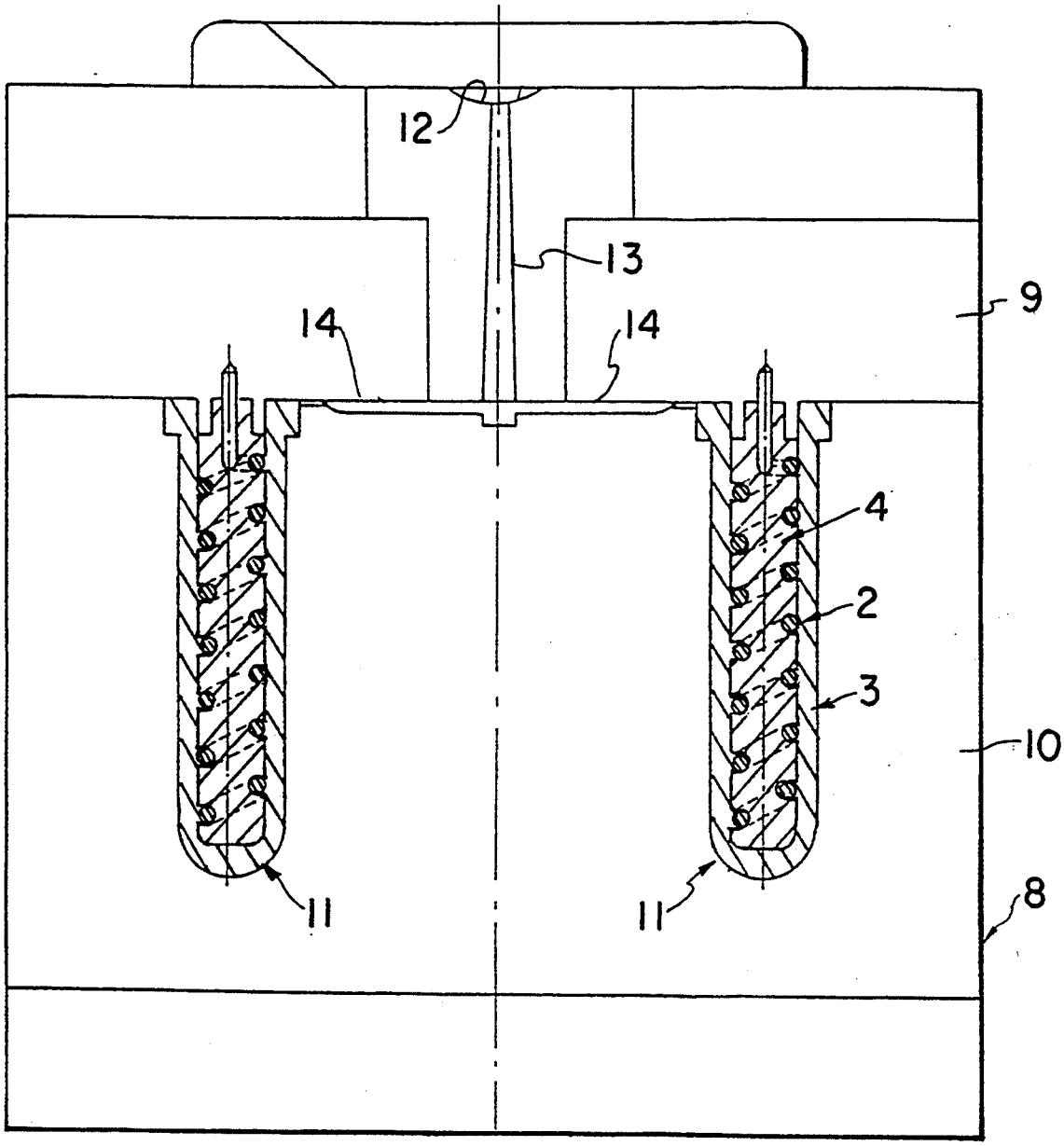
FIG. 2 is an elevational view in section of a casting mold used in a production method in accordance with the invention.

The injection mold 8 in FIG. 2 comprises at least two mold halves 9 and 10, which at the beginning of an injection molding cycle are separated. One of the mold halves 10 is provided with two antenna rod-shaped cavities 11, whereby only the mold half 9 is provided with a shape appropriate for the head (socket, prong, or equivalent) of the antenna rod 1, to be attached to the radio or radio telephone.

The injection mold 8 is furthermore provided with a receiving recess 12 of an injection nozzle, an inlet channel 13 for a polymer material, and distribution channels 14 for conducting the polymer material into the mold cavities 11.

The mold in FIG. 2 functions so that antenna leads 2 with the support structure 4 are secured to the holes in the mold half 9 when the mold is open. Thereafter the mold is closed, for instance, by moving the mold half 10 close to the mold half 9, whereby the antenna leads 2 with the support structures 4 remain extending in the middle of the mold cavities 11. Inside the mold cavity 11, the antenna lead/support structure-entity 2,4 is now surrounded by an empty space. A nozzle (not shown) is then inserted close to the receiving recess 12 of the mold 8, and liquid polymer material (either a liquid pre-thermoset or a molten thermoplastic) is injected through the nozzle, the inlet channel 13 and through the conducting channels 14 into the cavities 11 of the mold 8 where the entities including the antenna lead 2 and the support structure 4 are entirely surrounded by the plastic.

After the plastic injected into the mold cavities 11 has been cured (either by reactance or by cooling), the mold 8 is opened by separating the halves 9 and 10. Finally, the completed antenna rods are detached and separated from the remains of the conducting channel.

Figure 3:
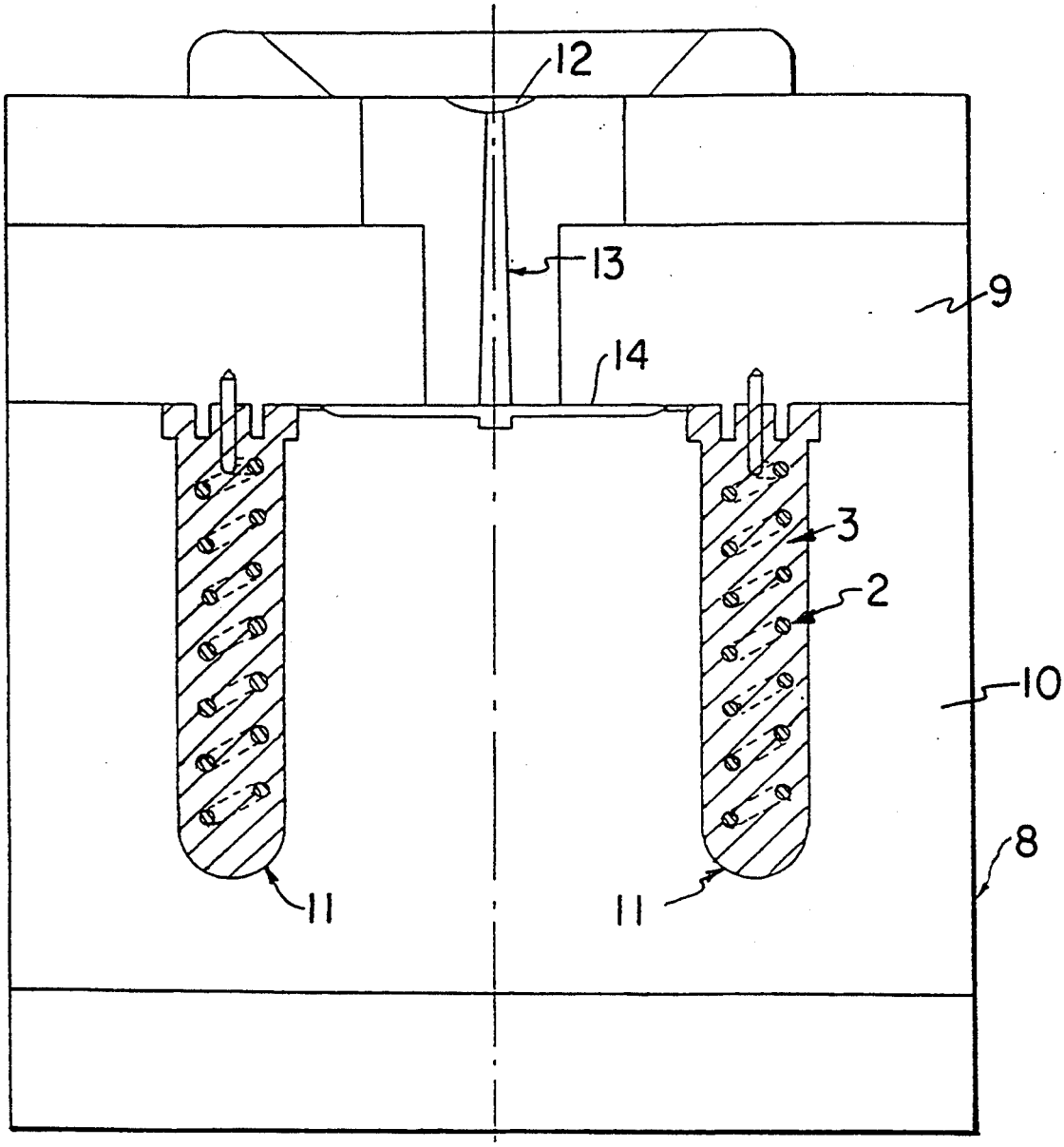
FIG. 3 is a view similar to FIG. 2 of a casting mold used in another production method in accordance with the invention.

A mold similar to that in FIG. 2, is seen in FIG. 3, with the exception that the leads 2 used in the procedure are so strong or stiff that no support structure is needed. It is therefore obvious that the mold cavities 11 are filled with an amount of polymer material that is equivalent to the total amount of polymer material which is equivalent to the total of the support structure layer 4 of FIGS. 1, 2 and the polymer material layer 3. Thus, an antenna rod-shaped polymer matrix is formed, in which only the antenna lead 2 has been immersed.

We claim:

1. A method for producing an antenna rod, comprising the steps of:

(a) joining an antenna lead with a rod-shaped supporting core structure by winding the antenna lead into a helical coil around the supporting core structure, (b) inserting the antenna lead and the supporting core structure in a cavity of a casting mold, which cavity is substantially of the shape of the antenna rod, said antenna lead and supporting core structure being positioned in said mold to extend longitudinally in said antenna rod;

(c) filling the cavity of the casting mold with molten flexible thermoplastic material, (d) solidifying the flexible thermoplastic material in the casting mold to form said antenna rod; and (e) removing the rod from the casting mold.

2. A method according to claim 1, wherein the antenna lead is joined with the supporting core structure by the step of immersing the lead at least partly into a grove in the supporting core structure.

3. A method according to claim 1 or 2, wherein the cavity of the casting mold is filled with said flexible thermoplastic material in step (c) by injection molding.

4. A method according to claim 3, further comprising the step of casting the supporting core structure in the presence of the antenna lead prior to step (a).

5. A method according to claim 1, further comprising the step of casting the supporting core structure in the presence of the antenna lead prior to step (a).

6. A method according to claim 5, wherein said supporting core structure is formed by injection molding with a flexible thermoplastic material.

7. A method for producing a solid antenna rod, comprising the steps of:

(a) forming an antenna lead into a helical coil having an open center;

(b) inserting the antenna lead in a cavity of a casting mold, which cavity is substantially of the shape of the antenna rod, said antenna lead being positioned in said mold to extend longitudinally in said antenna rod;

(c) filling the cavity of the casting mold including said open center of said coil with molten flexible thermoplastic material, (d) solidifying the flexible thermoplastic material in the casting mold to form said antenna rod; and (e) removing the rod from the casting mold.

8. A method according to claim 7, wherein the cavity of the casting mold is filled with said flexible thermoplastic material in step (c) by injection molding.

* * * * *